US010600400B2

(12) United States Patent
True

(10) Patent No.: US 10,600,400 B2
(45) Date of Patent: Mar. 24, 2020

(54) APPARTUS AND METHOD FOR NOISE CANCELLATION

(71) Applicant: JAGUAR LAND ROVER LIMITED, Coventry, Warwickshire (GB)

(72) Inventor: Sean True, Warwickshire (GB)

(73) Assignee: Jaguar Land Rover Limited, Warwickshire (GB)

( * ) Notice: Subject to any disclaimer, the term of this patent is extended or adjusted under 35 U.S.C. 154(b) by 0 days.

(21) Appl. No.: 16/084,112

(22) PCT Filed: Mar. 1, 2017

(86) PCT No.: PCT/EP2017/054819
§ 371 (c)(1),
(2) Date: Sep. 11, 2018

(87) PCT Pub. No.: WO2017/157669
PCT Pub. Date: Sep. 21, 2017

(65) Prior Publication Data

US 2019/0088247 A1 Mar. 21, 2019

(30) Foreign Application Priority Data

Mar. 17, 2016 (GB) ..... 1604555.1

(51) Int. Cl.
*G10K 11/178* (2006.01)

(52) U.S. Cl.
CPC ..... *G10K 11/17823* (2018.01); *G10K 11/178* (2013.01); *G10K 11/17853* (2018.01);
(Continued)

(58) Field of Classification Search
None
See application file for complete search history.

(56) References Cited

U.S. PATENT DOCUMENTS 5,758,311 A 5/1998 Tsuji et al.
2002/0136415 A1 9/2002 Daly
(Continued)

FOREIGN PATENT DOCUMENTS

EP 1193683 A2 4/2002
FR 2881235 A1 1/2005
(Continued)

OTHER PUBLICATIONS

International Search Report and Written Opinion, PCT/EP2017/054819, dated May 17, 2017, 15 pages.
(Continued)

*Primary Examiner* — Paul W Huber
(74) *Attorney, Agent, or Firm* — Nash Graham & Dunn LLP

(57) ABSTRACT

Embodiments of the present invention provide a noise cancellation system, comprising noise cancellation parameter selection means for receiving data indicative of one or more operating conditions associated with a vehicle and selecting one or more noise cancellation configuration parameters based thereon, and noise cancellation means for receiving one or more noise signals, determining an in-vehicle noise cancellation signal based on the one or more noise signals according to the one or more configuration parameters and outputting the in-vehicle noise cancellation signal for reducing noise in the vehicle.

20 Claims, 4 Drawing Sheets

(52) U.S. Cl.
CPC ..... *G10K 2210/128* (2013.01); *G10K 2210/1282* (2013.01); *G10K 2210/12821* (2013.01); *G10K 2210/3028* (2013.01); *G10K 2210/3033* (2013.01); *G10K 2210/30232* (2013.01); *G10K 2210/30351* (2013.01)

(56) References Cited

U.S. PATENT DOCUMENTS

2015/0356965 A1 12/2015 Tani et al.
2016/0221581 A1* 8/2016 Talwar ..... B60W 40/06

FOREIGN PATENT DOCUMENTS

GB 2275388 A 8/1994
GB 2305328 A 4/1997

OTHER PUBLICATIONS

Search and Examination Report, GB1604555.1, dated Sep. 7, 2016, 6 pages.
Search and Examination Report, GB1703317.6, dated Apr. 11, 2017, 6 pages.

* cited by examiner

APPARTUS AND METHOD FOR NOISE CANCELLATION

CROSS-REFERENCE TO RELATED APPLICATIONS

This application is a 371 of International Application No. PCT/EP2017/054819, filed Mar. 1, 2017, which claims priority to GB Patent Application 1604555.1, filed Mar. 17, 2016, the contents of both of which are incorporated by reference herein in their entirety.

TECHNICAL FIELD

The present disclosure relates to an apparatus and method for noise cancellation. Aspects of the invention relate to a noise cancellation system, to a method of generating a noise cancellation signal, and to a vehicle comprising a noise cancellation system.

BACKGROUND

Noise, especially within a vehicle, is troublesome for occupants of the vehicle. Noise within the vehicle may distract a driver of the vehicle and may be tiring for the occupants of the vehicle, for example. Mechanical measures have been used to reduce noise within vehicles. However such measures are bulky and heavy. The use of active noise cancellation has been suggested. Active noise cancellation involves the generation of a sound wave to cancel a noise sound wave thus making the environment quieter for a listener.

It is an object of embodiments of the invention to at least mitigate one or more of the problems of the prior art.

SUMMARY OF THE INVENTION

Aspects and embodiments of the invention provide a noise cancellation system, a method of generating a noise cancellation signal, and a vehicle comprising a noise cancellation system, as claimed in the appended claims.

According to an aspect of the invention, there is provided a noise cancellation system comprising noise cancellation parameter selection means for receiving data indicative of one or more operating conditions associated with a vehicle, and selecting one or more noise cancellation configuration parameters based thereon. Advantageously, the noise is processed in a predetermined way bespoke for the operating conditions associated with the vehicle to effectively reduce noise.

According to another aspect of the invention, there is provided a noise cancellation means for receiving one or more noise signals, and determining an in-vehicle noise cancellation signal based on the one or more noise signals according to the one or more configuration parameters and outputting the in-vehicle noise cancellation signal for reducing noise in the vehicle. Advantageously, noise from within the vehicle is reduced in a tailored manner according to the configuration parameters.

According to an aspect of the invention, there is provided a noise cancellation system, comprising noise cancellation parameter selection means for receiving data indicative of one or more operating conditions associated with a vehicle and selecting one or more noise cancellation configuration parameters based thereon, and noise cancellation means for receiving one or more noise signals, determining an in-vehicle noise cancellation signal based on the one or more noise signals according to the one or more configuration parameters and outputting the in-vehicle noise cancellation signal for reducing noise in the vehicle.

According to an embodiment of the invention, there is provided a system as described above, wherein said noise cancellation parameter selection means is a noise configuration unit. In some embodiments the noise configuration unit comprises one or more electronic processors having one or more electrical inputs for receiving said data indicative of the one or more operating conditions. The noise cancellation means may be a noise cancellation unit arranged to receive one or more said noise signals and to determine the in-vehicle noise cancellation signal. The noise cancellation unit may comprise one or more electronic processors. The noise configuration unit and noise cancellation unit may each comprise an electronic memory device electrically coupled to the electronic processor having executable instructions stored therein.

Optionally, the noise cancellation parameter selection means is arranged to determine an attribute of a surface on which the vehicle is travelling in use. The noise cancellation parameter selection means may select the one or more noise cancellation configuration parameters based on the attribute. Advantageously, an influence on noise experienced within the vehicle associated with the surface on which the vehicle is travelling is addressed.

Optionally, the attribute of the surface is a roughness of the surface. The noise cancellation parameter selection means may be arranged to determine the roughness of the surface based on at least one of the noise signals received from a noise sensing means associated with the vehicle. The noise cancellation parameter selection means may be arranged to select the one or more noise cancellation configuration parameters based on the roughness of the surface. Advantageously, noise associated with the roughness of the surface is addressed.

Optionally, the noise sensing means is associated with a suspension of the vehicle. Advantageously, noise associated with the suspension of the vehicle is addressed.

Optionally, the noise cancellation parameter selection means is arranged to determine the attribute of the surface based on one or both of an amplitude and a spectral composition of the noise signal. Advantageously, this allows for effective attribute determination.

Optionally, the data indicative of the one or more operating conditions comprises a driving mode of the vehicle. The or each driving mode may correspond to a particular driving condition or set of driving conditions, and in each mode each of one or more vehicle sub-systems may be set to a function mode most appropriate to those conditions. A control system for controlling the one or more vehicle sub-systems in dependence on the driving mode is set out in the applicant's U.S. Pat. No. 7,349,776B and PCT application No. WO2013/004764A1, the contents of which are hereby incorporated by reference.

In some embodiments the noise cancellation parameter selection means may be arranged to select the one or more noise cancellation configuration parameters in dependence on the driving mode of the vehicle. Advantageously, noise associated with a particular driving condition or set of driving conditions is addressed. For example, it may be desirable for some driving conditions for the associated noise to be reduced to a minimum. Alternatively, for other driving conditions it may be desirable for the associated noise to be reduced to or maintained at a level audible to a user of the vehicle. Advantageously, the associated noise assists the user when driving the vehicle by providing audible feedback in certain conditions, such as when driving off-road, for example.

In some embodiments the extent to which the associated noise is reduced or cancelled may be selectable by a user of the vehicle. Advantageously, this allows the user to maintain at least some audible feedback where desired or necessary.

In an embodiment of the invention, the data indicative of the one or more operating conditions comprises data indicative of a speed of the vehicle. Advantageously, noise associated with the speed of the vehicle is addressed.

Optionally, the data indicative of the one or more operating conditions comprises data indicative of a speed of one or both of an engine and a motor associated with the vehicle. Advantageously, noise associated with the speed of one or both of the engine and motor is addressed.

Optionally, the data indicative of the one or more operating conditions comprises data indicative of an operating mode of an engine and/or motor associated with the vehicle. The noise cancellation parameter selection means may be arranged to select the one or more noise cancellation configuration parameters in dependence on whether the engine/motor is operating in a hybrid mode, for example. Advantageously, in vehicles having hybrid capability, noise associated with different operating modes of an engine and/or motor is addressed.

Optionally, the data indicative of the one or more operating conditions comprises data indicative of the operational state of one or more vehicle sub-systems. The one or more vehicle sub-systems may comprise an anti-lock braking system (ABS), or a traction control system. Advantageously, noise associated with the one or more vehicle sub-systems is addressed.

Optionally, the data indicative of the one or more operating conditions comprises data indicative of a gear selection. Advantageously, noise associated with different gear selections is addressed. In some embodiments data indicative of a gear selection comprises an indication that no gear is selected—i.e. the vehicle is in a coasting or gliding event. Advantageously, noise associated with such events is addressed.

Optionally, the data indicative of the one or more operating conditions comprises data indicative of a steering angle of the vehicle. The steering angle may comprise an angle of rotation of a steering wheel or steerable wheel of the vehicle. Advantageously, noise associated with different steering angles is addressed.

Optionally, the data indicative of the one or more operating conditions comprises data indicative of an orientation of the vehicle. In some embodiments the data indicative of the orientation of the vehicle may comprise a yaw angle, roll angle and/or pitch angle.

Optionally, the data indicative of the one or more operating conditions comprises data indicative of an activation of one or more wipers associated with the vehicle. Optionally, the data indicative of the one or more operating conditions comprises data indicative of a speed of one or more wipers associated with the vehicle. Advantageously, activation of wipers is indicative of the vehicle being operated in wet conditions, which may influence noise within the vehicle.

Optionally, the data indicative of the one or more operating conditions comprises data indicative of one or more of ambient temperature and a configuration of a vehicle suspension. The ambient temperature may be one or both of an internal ambient temperature or an external ambient temperature of the vehicle. Advantageously, the temperature influences a time of flight of sound, whilst the vehicle suspension influences a communication of noise—causing vibrations. Optionally, the configuration of the vehicle suspension may comprise an operational state of a suspension pump.

Optionally, the data indicative of the one or more operating conditions comprises data indicative of the temperature of one or more tyres of the vehicle. Advantageously, noise associated with different tyre temperatures, which may alter the frequency content of noise within the vehicle, is addressed.

Optionally, the data indicative of the one or more operating conditions comprises data indicative of a position of one or more aperture members of the vehicle. The one or more aperture members may be configured to open, close and/or adjust the size of one or more apertures of the vehicle. The one or more apertures may comprise a window or an openable roof of the vehicle, such as a sun roof or convertible roof, for example. Additionally or alternatively, the one or more aperture members may comprise a blind or cover for a window or windshield of the vehicle. Advantageously, noise associated with different positions of the one or more aperture members and/or different sizes of the apertures of the vehicle, which may alter the frequency or amplitude content of the noise, is addressed.

Optionally, the data indicative of the one or more operating conditions comprises data indicative of the constituents of one or more components of the vehicle. For example, the one or more components may comprise a glass window or windshield, for example. In such embodiments, the data indicative of the one or more operating conditions comprises the type of glass from which the or each component is formed.

Optionally, the data indicative of the one or more operating conditions comprises data indicative of a position of an aerodynamic device of the vehicle. The aerodynamic device may comprise a spoiler, such as a deployable spoiler. Advantageously, noise associated with the position of the aerodynamic device is addressed.

Optionally, the data indicative of the one or more operating conditions comprises data indicative of the operational state of a heating, ventilation and air conditioning (HVAC) system of the vehicle. The operational state may comprise a speed of one or more fans forming part of the HVAC system. Advantageously, noise associated with the operation of the HVAC system is addressed.

Optionally, the data indicative of the one or more operating conditions comprises data indicative of an ambient noise level in the environment external to the vehicle. Advantageously, ambient noise is addressed.

Optionally, the data indicative of the one or more operating conditions comprises data indicative of a load present on a tow bar or hitch point of the vehicle. Advantageously, noise associated with a load being towed is addressed.

Optionally, the data indicative of the one or more operating conditions comprises data indicative of a fuel level of the vehicle. The data indicative of the fuel level may comprise a fuel gauge position. Advantageously, noise associated with different fuel levels is addressed.

In an embodiment of the invention, the noise cancellation parameter selection means is arranged to operatively perform a pattern matching algorithm for selecting the one or more noise cancellation configuration parameters based on a similarity to one or more predetermined operating conditions. Advantageously, the noise cancellation is tuned to a predetermined configuration.

Optionally, the pattern matching algorithm is one of a k-means or nearest neighbour algorithm.

Optionally, the one or more noise cancellation configuration parameters are associated with at least one function for determining the in-vehicle noise cancellation signal based on the one or more noise signals. The parameters that may be associated with the at least one function are one or more filter coefficients.

Optionally, the function is be a speaker transfer function (STF) indicative of a transfer function from one or more audio output devices.

Optionally, the function is a reference transfer function (RTF) indicative of a transfer function from one or more noise sensing means.

According to an aspect of the invention, there is provided a method of generating a noise cancellation signal comprising receiving data indicative of one or more operating conditions associated with a vehicle. The method may comprise selecting one or more noise cancellation configuration parameters based on the received data. The method may comprise receiving one or more noise signals, generating an in-vehicle noise cancellation signal based on the one or more noise signals according to the one or more configuration parameters, and outputting the in-vehicle noise cancellation signal for reducing noise in the vehicle.

In an embodiment of the invention, the method comprises determining an attribute of a surface on which the vehicle is travelling, and selecting the one or more noise cancellation configuration parameters based on the attribute.

In an embodiment of the invention, the attribute of the surface is a roughness of the surface and the method comprises determining the roughness of the surface based on at least one of the noise signals received from a noise sensing means associated with the vehicle, and selecting the one or more noise cancellation configuration parameters based on the roughness of the surface.

Optionally, the noise sensing means is associated with a suspension of the vehicle.

Optionally, the method comprises determining the attribute of the surface based on one or both of an amplitude and a spectral composition of the noise signal.

Optionally, the data indicative of the one or more operating conditions comprises a driving mode of the vehicle. The or each driving mode may correspond to a particular driving condition or set of driving conditions, and in each mode each of one or more vehicle sub-systems may be set to a function mode most appropriate to those conditions.

In some embodiments the method comprises selecting the one or more noise cancellation configuration parameters in dependence on the driving mode of the vehicle. Advantageously, noise associated with a particular driving condition or set of driving conditions may be addressed. For example, it may be desirable for some driving conditions for the associated noise to be reduced to a minimum. Alternatively, for other driving conditions it may be desirable for the associated noise to be reduced to or maintained at a level audible to a user of the vehicle. Advantageously, the associated noise assists the user when driving the vehicle by providing audible feedback in certain conditions, such as when driving off-road, for example.

In some embodiments the extent to which the associated noise is reduced or cancelled is selected by a user of the vehicle. Advantageously, this allows the user to maintain at least some audible feedback where desired or necessary.

Optionally, the data indicative of the one or more operating conditions comprises data indicative of a speed of the vehicle, a speed of one or both of an engine and a motor associated with the vehicle, an activation or speed of one or more wipers associated with the vehicle, and/or one or more of ambient temperature and a configuration of a vehicle suspension. The ambient temperature may be one or both of an internal ambient temperature or an external ambient temperature of the vehicle. Optionally, the configuration of the vehicle suspension may comprise an operational state of a suspension pump of the vehicle.

Optionally, the data indicative of the one or more operating conditions comprises data indicative of an operating mode of an engine and/or motor associated with the vehicle. The method may comprise selecting the one or more noise cancellation configuration parameters in dependence on whether the engine/motor is operating in a hybrid mode, for example. Advantageously, in vehicles having hybrid capability, noise associated with different operating modes of an engine and/or motor is addressed.

Optionally, the data indicative of the one or more operating conditions comprises data indicative of the operational state of one or more vehicle sub-systems. The one or more vehicle sub-systems may comprise an anti-lock braking system (ABS), or a traction control system. Advantageously, noise associated with the one or more vehicle sub-systems is addressed.

Optionally, the data indicative of the one or more operating conditions comprises data indicative of a gear selection. Advantageously, noise associated with different gear selections is addressed. In some embodiments data indicative of a gear selection comprises an indication that no gear is selected—i.e. the vehicle is in a coasting or gliding event. Advantageously, noise associated with such events is addressed.

Optionally, the data indicative of the one or more operating conditions comprises data indicative of a steering angle of the vehicle. The steering angle may comprise an angle of rotation of a steering wheel or steerable wheel of the vehicle. Advantageously, noise associated with different steering angles is addressed.

Optionally, the data indicative of the one or more operating conditions comprises data indicative of an orientation of the vehicle. In some embodiments the data indicative of the orientation of the vehicle comprises a yaw angle, roll angle and/or pitch angle.

Optionally, the data indicative of the one or more operating conditions comprises data indicative of the temperature of one or more tyres of the vehicle. Advantageously, noise associated with different tyre temperatures, which may alter the frequency content of noise within the vehicle, is addressed.

Optionally, the data indicative of the one or more operating conditions comprises data indicative of a position of one or more aperture members of the vehicle. The one or more aperture members may be configured to open, close and/or adjust the size of one or more apertures of the vehicle. The one or more apertures may comprise a window or an openable roof of the vehicle, such as a sun roof or convertible roof, for example. Additionally or alternatively, the one or more aperture members may comprise a blind or cover for a window or windshield of the vehicle. Advantageously, noise associated with different positions of the one or more aperture members and/or different sizes of the apertures, which may alter the frequency or amplitude content of the noise, is addressed.

Optionally, the data indicative of the one or more operating conditions comprises data indicative of the constituents of one or more components of the vehicle. For example, the one or more components may comprise a glass window or windshield, for example. In such embodiments, the data indicative of the one or more operating conditions comprises the type of glass from which the or each component is formed.

Optionally, the data indicative of the one or more operating conditions comprises data indicative of a position of an aerodynamic device of the vehicle. The aerodynamic device may comprise a spoiler, such as a deployable spoiler. Advantageously, noise associated with the position of the aerodynamic device is addressed.

Optionally, the data indicative of the one or more operating conditions comprises data indicative of the operational state of a heating, ventilation and air conditioning (HVAC) system of the vehicle. The operational state may comprise a speed of one or more fans forming part of the HVAC system. Advantageously, noise associated with the operation of the HVAC system is addressed.

Optionally, the data indicative of the one or more operating conditions comprises data indicative of an ambient noise level in the vehicle's environment. Advantageously, ambient noise is addressed.

Optionally, the data indicative of the one or more operating conditions comprises data indicative of a load present on a tow bar or hitch point of the vehicle. Advantageously, noise associated with a load being towed is addressed.

Optionally, the data indicative of the one or more operating conditions comprises data indicative of a fuel level of the vehicle. The data indicative of the fuel level may comprise a fuel gauge position. Advantageously, noise associated with different fuel levels is addressed.

In an embodiment of the invention, to the method comprises operatively performing a pattern matching algorithm for selecting the one or more noise cancellation configuration parameters based on a similarity to one or more predetermined operating conditions.

Optionally, the method comprises associating the noise cancellation configuration parameters with at least one function for determining the noise cancellation signal based on the one or more noise signals.

Optionally, the configuration parameters associated with the at least one function are one or more filter coefficients.

In an embodiment of the invention, the function is one of a speaker transfer function (STF) indicative of a transfer function from one or more audio output devices and a reference transfer function (RTF) indicative of a transfer function from one or more noise sensing means.

According to an aspect of the invention, there is provided a vehicle comprising a noise cancellation system according to an aspect of the invention.

According to an aspect of the invention, there is provided computer software which, when executed by a computer, is arranged to perform a method according to an aspect of the invention. Optionally, the computer software is stored on a computer-readable medium. The software may be tangibly stored on the computer readable medium.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described by way of example only, with reference to the accompanying drawings, in which.

DETAILED DESCRIPTION

Figure 1:
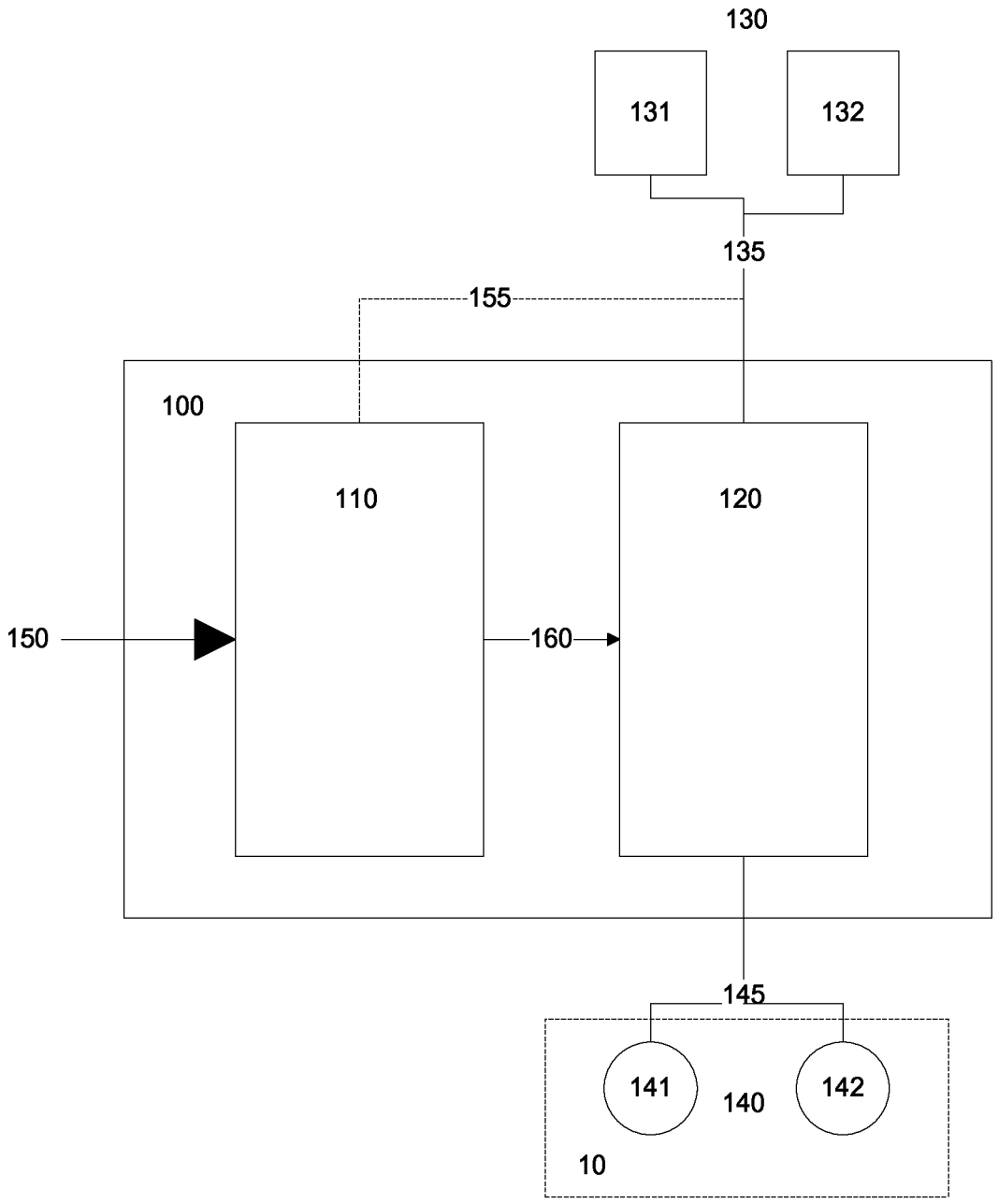
FIG. 1 shows a system according to an embodiment of the invention.

FIG. 1 illustrates a noise cancellation system 100 according to an embodiment of the invention. The system 100 comprises noise cancellation means 120 and noise cancellation parameter selection means 110. The noise cancellation parameter selection means 110 is arranged to select one or more configuration parameters of the noise cancellation means 120 based on one or more inputs, as will be explained. In use, the noise cancellation parameter selection means 110 is arranged to determine one or more operational characteristics and to select the configuration parameters of the noise cancellation means 120 accordingly in order to improve noise cancellation. In some embodiments the one or more configuration parameters are associated with at least one transfer function associated with the noise cancellation system, as will be explained.

The noise cancellation parameter selection means 110 may be provided in the form of a processor which operatively executes software instructions to determine the one or more configuration parameters of the noise cancellation means 120. Hereinafter the noise cancellation parameter selection means 110 will be referred to as a noise configuration unit 110. Similarly, the noise cancellation means 120 may be one or more processing devices which are arranged, in use, to determine at least one noise cancellation signal 145 for reducing noise and to provide the noise cancellation signal 145 to one or more audio output means 141, 142, as will be explained. The audio output means 141, 142 may be one or more acoustic devices, such as speakers 141, 142. The at least one noise cancellation signal 145 may be determined based upon at least one noise signal 135 input from one or more noise input means 131, 132 as one or more reference signals. The one or more noise input means 131, 132 may be one or more vibro-acoustic sensing devices such as microphones or accelerometers 131, 132. Hereinafter the noise cancellation means 120 will be referred to as a noise cancellation unit 120.

The noise cancellation system 100 may be used within a vehicle, such as a land-going vehicle, although it will be realise that other sorts of vehicle are envisaged, such as aircraft and water-borne vehicles.

Noise is a significant issue within vehicles. A noisy environment with the vehicle is detrimental to occupant(s) of the vehicle, such as to enjoyment and comfort of the occupant(s). For example, the occupant(s) of the vehicle may become tired through exposure to noise within the vehicle. Furthermore, a characteristic of a premium vehicle is that an environment within the vehicle is relatively quiet. Noise cancellation may be used to reduce the noise experienced by one or more occupants within the vehicle. However it has been noted that the noise cancellation may not be effective across a wide operating range of the vehicle. The noise cancellation system 100 may be arranged to selectively reduce noise arising from one or more predetermined sources such as, although not exclusively, road noise, wind noise, engine noise etc. The noise cancellation system 100 is arranged to adapt to one or more operating conditions of the vehicle.

The noise cancellation unit 120 is arranged to reduce noise within one or more noise cancellations zones 10 within the vehicle. In one embodiment, substantially the entire interior of the vehicle is determined as the noise cancellation zone 10. That is, there may be only one noise cancellation zone 10 within the vehicle. However, in some embodiments, a plurality of noise cancellation zones are located within the vehicle. In this case the noise cancellation unit 120 may provide at least one specific noise cancellation signal 145 to audio output means 141, 142 within the respective noise cancellation zone. That is, different noise cancellation signals may be provided to each noise cancellation zone. The noise cancellation unit 120 may utilise different configuration parameters to determine the noise cancellation signals for each noise cancellation zone. Each of the one or more noise cancellation zones 10 within the vehicle may be arranged proximal to an expected location of at least one occupant of the vehicle. For example, a first noise cancellation zone may be arranged proximal to an intended location of a driver of the vehicle. The intended location may correspond to a head location of the occupant. A second, and possibly further, noise cancellation zone(s) may be respectively arranged in relation to each potential further occupant within the vehicle and, in some embodiments corresponding to an expected head location of each occupant. For example, a second noise cancellation zone may be arranged proximal to an intended head location of a front passenger of the vehicle.

One or more noise signals 135 received from the one or more noise input means 131, 132 may be provided, in some embodiments, to the noise configuration unit 110 as a parameter selection signal 155. In some embodiments, the noise configuration unit 110 is arranged to determine the noise cancellation configuration parameters based, at least in part, on the parameter selection signal 155. In some embodiments, the noise configuration unit 110 is arranged to receive operational data 150 indicative of operational characteristics of a vehicle with which the system 100 is associated. In some embodiments, the noise configuration unit 110 is arranged to determine the noise cancellation configuration parameters based, at least in part, on the operational data 150. Data indicative of one or more noise cancellation configuration parameters 160 are provided from the noise configuration unit 110 to the noise cancellation unit 120.

Figure 2:
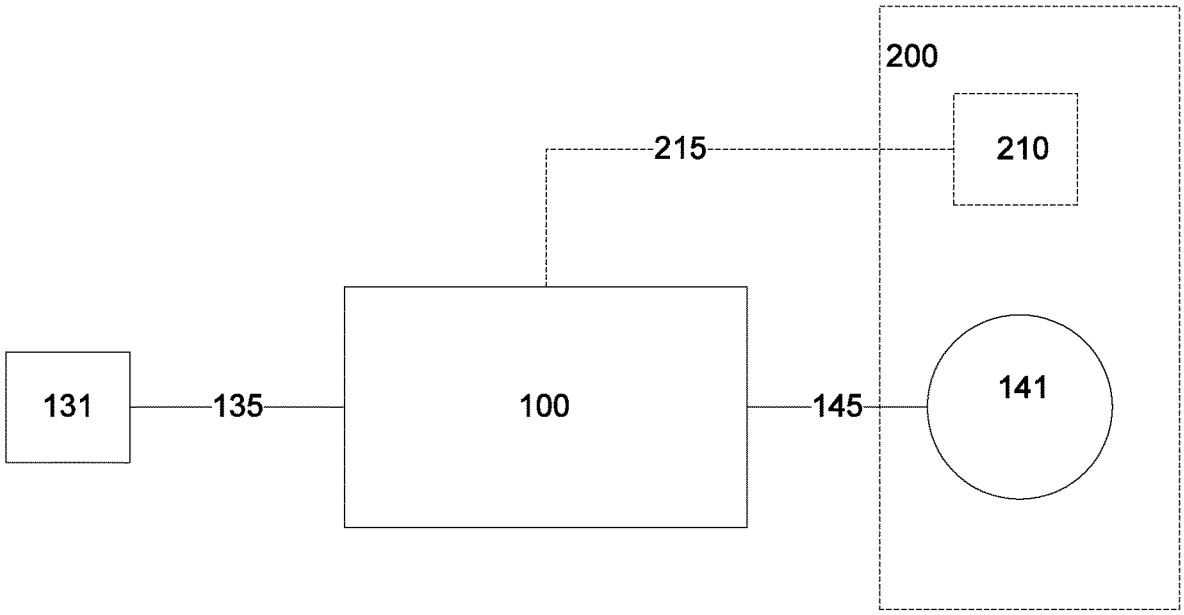
FIG. 2 shows a system according to an embodiment of the invention arranged in use.

FIG. 2 illustrates an embodiment of the noise cancellation system 100 arranged in use. The noise cancellation system 100 is illustrated as connected to a first noise input means 131 and a first audio output means 141. It will be realised, however, that this is not limiting and that the system 100 may be connected to more than one input 131 and output 141 means, respectively. Furthermore it is not necessary for the number of input means 131 to equals the number of output means 141. The first audio output means 141 may be associated with a first noise cancellation zone 200.

As noted above, the noise input means 131 is at least one acoustic sensing device for providing the reference signal. In the example shown in FIG. 2 the noise input means 131 is an accelerometer 131. The accelerometer is 131 is arranged upon a component of a vehicle to determine and output data indicative of structural vibration of a portion of the vehicle in use. In one embodiment the accelerometer 131 is arranged upon a suspension component of the vehicle, such as a wheel hub carrier of the vehicle, although it will be realised that the accelerometer 131 may be mounted elsewhere about the vehicle and, in particular, the suspension thereof. The accelerometer 131 is arranged to, in use, output a signal 135 indicative of vibration applied thereto and, hence, noise caused within the vehicle.

The signal 135 is received by the noise cancellation system 100. As will be appreciated, with the accelerometer 131 mounted about the suspension of the vehicle, vibrations applied thereto are characteristic, at least, of a road surface being traveled upon by the vehicle and may also be characteristic of a speed of travel of the vehicle on the road surface.

The noise cancellation system 100 is arranged to output a noise cancellation signal 145 to the audio output means 141, wherein the audio output means 141 outputs an audible signal corresponding thereto. The audio output means 141 is, in one embodiment, an audio output device such as a speaker arranged within an occupant compartment of the vehicle i.e. within an interior of the vehicle. The speaker 141 may be arranged within, for example, a dashboard, interior body panel or door panel of the vehicle, although it will be realised that these embodiments are not exhaustive. In one embodiment the speaker 141 is arranged within a headrest of the vehicle proximal to an occupant's expected head position. The speaker 141 may be located within a noise cancellation zone indicated with dotted line denoted 200 in FIG. 2.

As illustrated, in the noise cancellation system 100, first noise input means 131 and first audio output means 141 form an open-loop system. In some embodiments a closed-loop system is formed by the inclusion of one or more feedback means 210. The feedback means 210 provides a feedback signal 215 to the noise cancellation system 100. The feedback signal is indicative of noise within the noise cancellation zone 200. Therefore the feedback signal 215 may be an error signal indicative of remaining noise present within the noise cancellation zone 200. The error signal may correspond to a sum of the noise within the noise cancellation zone 200, the audible signal corresponding to the noise cancellation signal 145 and, in some circumstances, an intended audio signal within the noise cancellation zone such as audio output by an entertainment system of the vehicle such as music. It will be appreciated that the noise cancellation signal 145 may have a minus sign intended to cancel the noise within the noise cancellation zone 200. The feedback means 210 may be at least one microphone arranged within the noise cancellation zone 200. For example, in one embodiment, the feedback means 210 may be a microphone arranged within the occupant compartment of the vehicle. The microphone 210 may be arranged within a headrest of the vehicle. In a closed-loop system the determined noise cancellation configuration parameters may provide a starting point which the feedback signal from the feedback means 210 is used to optimise.

Figure 3:
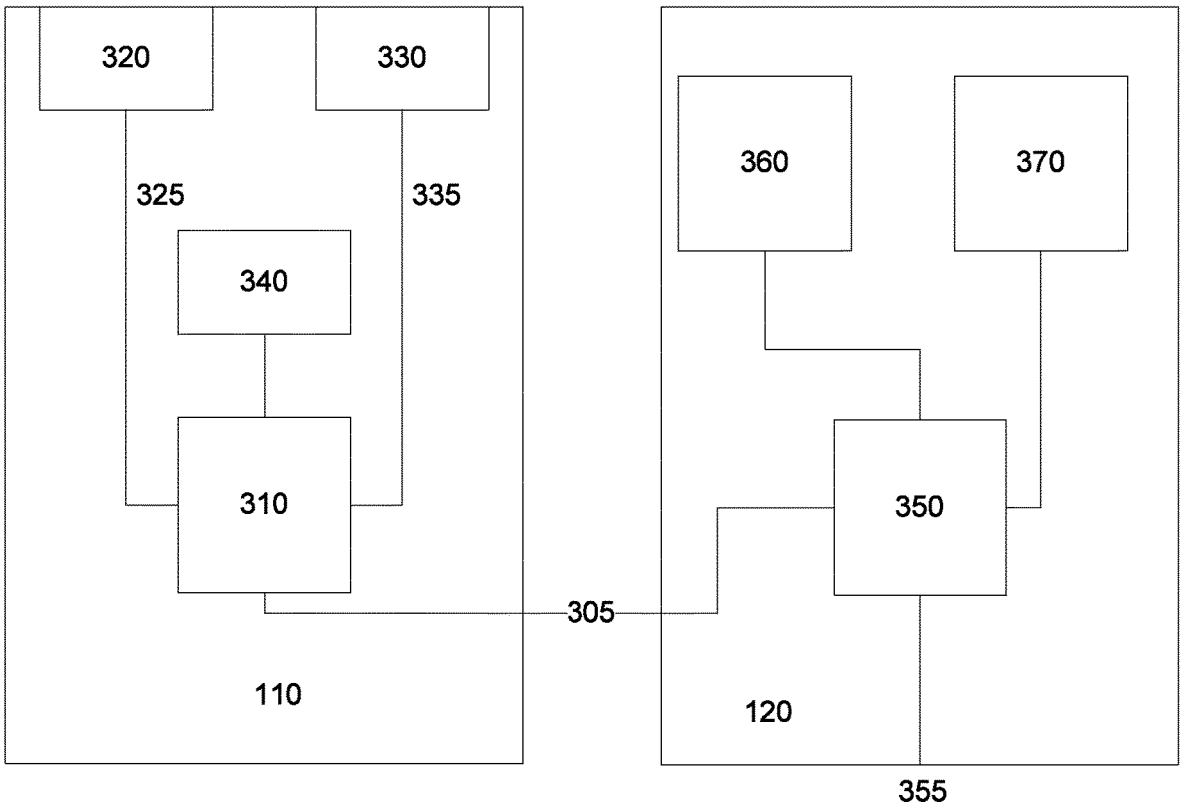
FIG. 3 schematically illustrates a system according to an embodiment of the invention.

FIG. 3 schematically illustrates a structure of the noise configuration unit 110 and the noise cancellation unit 120 according to an embodiment of the invention.

The noise configuration unit 110 comprises a processing unit 310 for operatively executing an algorithm for determining the one or more configuration parameters of the noise cancellation unit 120. The processing unit 310 comprises one or more processing devices for operatively executing an algorithm for determining the configuration parameters. The determined one or more configuration parameters are provided to the noise cancellation unit 120 as parameters 305.

The processing unit 310 is communicably connected to an interface 320 for receiving acoustic data 325 from one or more noise input means 131 such as one or more acoustic sensing devices which, as discussed above, may be microphones or accelerometers or a combination thereof arranged to provide reference signals. Each acoustic sensing device 131 provides respective acoustic data 325 via the interface 320 to the processing unit 310. The acoustic data 325 provided from each acoustic sensing device 131 may correspond to a predetermined portion of the vehicle, such as a respective noise cancellation zone 200. The interface 320 may receive data from the noise input means via a dedicated audio data communication bus.

The processing unit 310 may, in some embodiments, be communicably connected to an interface 330 for receiving operational data 335 indicative of operational characteristics of the vehicle. As explained below, the interface 330 may be arranged to communicate with one or more systems of the vehicle to determine an operational state of each system and/or to determine operational information about the vehicle. The operational characteristics may be, for example, information about one or more settings or status of the vehicle or a number of occupants of the vehicle. The interface 330 may be communicably coupled with a communication bus of the vehicle to receive the operational data 335 from the one or more systems of the vehicle. For example, the interface may communicate with a seatbelt monitoring system of the vehicle to determine the number of occupants of the vehicle based on a number of seatbelts fastened. Alternatively the number of occupants may be determined from a system using one or more interior cameras of the vehicle. The interface 330 may receive exhaust data indicative of an exhaust setting or configuration of the vehicle, such as data indicative of a position of an exhaust control valve. The exhaust control valve may be operated by an engine management system of the vehicle based upon, for example, engine speed or load. The interface 330 may receive operational data 335 from other systems of the vehicle, such as a suspension control system, gearbox control system, etc. as will be appreciated.

The one or more configuration parameters 305 of the noise cancellation unit 120 are determined by the processing unit 310 of the noise configuration unit 110 based on one or both of the received acoustic data 325 and the operational data 335. The configuration parameters 305 may be a plurality of configuration parameters 305 for providing to the noise cancellation unit 120, as will be explained. The configuration parameters may be associated with one or more transfer functions of the noise cancellation unit 120. In particular, the configuration parameters may be one or more coefficients of the one or more transfer functions of the noise cancellation unit 120. In one embodiment, the configuration parameters 305 may comprise a plurality of coefficients associated with at least one transfer function of the noise cancellation unit 120.

The noise configuration unit 110 comprises a parameter data store 340. The parameter data store 340 stores data representing a plurality of configurations of the noise configuration unit 110. The processing unit 310 is arranged to select one of the configurations according to the data 325, 335 received via one or both of interface 320, 330. That is, according to one or both of the acoustic data 325 and the operational data 335. The data representing the plurality of configurations of the noise configuration unit 110 may comprise a plurality of sets of data for configuring the noise cancellation unit 120 to a respective configuration. The plurality of sets of data may be a plurality of tables of configuration data, although it will be realised that embodiments of the invention are not limited in this respect. In one embodiment, the parameter data store stores a plurality of sets of the one or more coefficients of the one or more transfer functions of the noise cancellation unit 120 which are selected according to one or both of the acoustic data 325 and the operational data 335.

In one embodiment, the noise cancellation unit 120 comprises a first data store 360 storing at least one reference transfer function (RTF) and a second data store 370 storing at least one speaker transfer function (STF). Although illustrated as first and second data stores 360, 370 it will be realised that the data stores may be unified i.e. the noise cancellation unit 120 may comprise only one data store including both RTF and STF. The noise cancellation unit 120 further comprises a processing unit 350 communicably connected to the data stores 360, 370. The processing unit 350 comprises one or more processing devices for operatively executing an algorithm for determining the noise cancellation signal which is output via an interface 355. The algorithm is based upon the one or more configuration parameters received from the noise configuration unit 110.

The RTF represents a transfer function from one or more sources of reference data to one or more noise cancellation zones. In particular, the RTF may represent a transfer function indicative of a transform of the reference information such as provided from the one or more acoustic sensing devices 131, 132. The RTF may be indicative of a transformation of noise from the acoustic sensing devices 131, 132 to one or more noise cancellation zones 200. A respective RTF may be provided for each cancellation zone 200. The RTF may comprise a plurality of coefficients. The RTF may represent be used to configure a filter. The RTF represents how noise within the vehicle is caused by acoustic signals at the acoustic sensing devices. For example, the RTF may place emphasis on acoustic signals in one or more frequency ranges resulting in noise within the noise cancellation zone 200.

The STF represents a transfer function from the one or more audio output devices 141, 142. The STF may represent a transfer function from an audio output device to a noise cancellation zone 200. A respective STF may be provided for each cancellation zone 200. Each STF may be configured according to a respective number of occupants of the vehicle. That is, as the number of occupants may influence a signal output by a speaker being received in the noise cancellation zone 200, respective STFs may be provided for one or both of the number of occupants and seating positions of those occupants within the vehicle. The STF may comprise a plurality of coefficients. For example, the STF may place emphasis on acoustic signals in one or more frequency ranges resulting in noise within the noise cancellation zone 200.

The configuration parameters 305 received at the noise cancellation unit 120 may configure one or both of the at least one RTF or STF according to the operating conditions of the vehicle. In one embodiment a plurality of RTFs and/or STFs are stored within the noise cancellation unit 120 and are selected according to the configuration parameters 305 received from the noise configuration unit 110.

In some embodiments the noise cancellation unit 120 is operative based on a plurality of filter coefficients to determine the noise cancellation signal 145. Each acoustic device 141, 142 may be associated with one or more filter coefficients. In particular, each acoustic device may be associated with a plurality of filter coefficients where each filter coefficient corresponds to a respective reference acoustic pattern. The filter coefficients may be represented as $w_{km}[i]$ which denotes a filter coefficient to drive an acoustic device m based on a k-th reference acoustic pattern.

In some embodiments the configuration parameters 305 received at the noise cancellation unit 120 configure utilisation of one or more noise input means 131, 132. In particular, one or more noise input means 131, 132 may be selectively activated for use in determining one or more noise cancellation signals according to the configuration parameters. For example, when overtaking another vehicle, particularly a large vehicle that may create a lot of noise one or more noise input means 131, 132 may be activated or deactivated, appropriately, in order to optimise noise cancellation within the vehicle. That is, noise signals from a subset of noise input means 131, 132 may be used to determine one or more noise cancellation signals according to the configuration parameters.

The noise configuration unit 110 is arranged to determine one or more operational characteristics of the vehicle.

As explained above, the noise configuration unit 110 is arranged to receive acoustic data 325. For example, the noise configuration unit 110 may receive an input from at least one acoustic sensing device, such as accelerometer 131, indicative of respective accelerations applied thereto. The noise configuration unit 110 is arranged to determine a characteristic of a surface on which the vehicle is operatively travelling from the acoustic data 325. The characteristic may be a roughness of the surface of the surface on which the vehicle is travelling. The surface roughness may be determined from one or both of an amplitude and a spectral composition of a signal output by the one or more acoustic sensing devices 131, 132. The noise configuration unit 110 may process the received acoustic data 325 such as by applying a Fourier transform to the received acoustic data 325 to determine one or more frequency components of the signal from which the surface roughness may be determined.

As explained above, in some embodiments the noise configuration unit 110 is further communicatively coupled to a communication bus of the vehicle to receive operational data 335 indicative of the operational characteristics from the communication bus. The communication bus may, for example, be a CAN bus or an Internet Protocol (IP) based communication bus of the vehicle, such as Ethernet-based, although it will be realised that embodiments of the invention are not limited in this respect.

One operational characteristic may be vehicle speed. The vehicle speed may be usefully combined, in some embodiments, with information indicative of the surface roughness as discussed above. In some embodiments one or more coefficients associated with the RTF may be selected based on the surface roughness and vehicle speed.

One operational characteristic may be a driving mode of the vehicle. As explained above, a driving mode may correspond to a particular driving condition or set of driving conditions, and in each mode each of one or more vehicle sub-systems may be set to a function mode most appropriate to those conditions. In some embodiments one or more coefficients associated with the RTF may be selected based on the driving mode.

Additionally or alternatively, the one or more coefficients associated with the RTF may be based on a request or selection of the extent to which associated noise is to be cancelled/reduced. The request or selection may be made by a user of the vehicle.

An operational characteristic may be engine and/or motor speed i.e. electric motor speed of the vehicle. Engine and/or motor speed may cause vibrations of the vehicle which may be sensed by the acoustic sensing devices 131 i.e. represented in the acoustic data 325. Determining the engine and/or motor speed advantageously allows adaption of the noise cancellation unit 120 to reduce an influence of the engine and/or motor induced vibrations. In some embodiments one or more coefficients associated with the RTF may be selected based on the engine and/or motor speed.

An operational characteristic may be an operating mode of an engine and/or motor associated with the vehicle, such as a hybrid mode, for example. In some embodiments one or more coefficients associated with the RTF may be selected based on the operating mode.

One operational characteristic may be the operational state of one or more sub-systems of the vehicle. In some embodiments one or more coefficients associated with the RTF may be selected based on the operational state of one or more sub-systems of the vehicle.

One operational characteristic may be a steering angle of the vehicle, for example a rotational angle of a steering wheel or steerable wheel of the vehicle. In some embodiments one or more coefficients associated with the RTF may be selected based on the steering angle.

One operational characteristic may be an orientation of the vehicle. In some embodiments one or more coefficients associated with the RTF may be selected based on the orientation of the vehicle.

An operational characteristic may be wiper activation of the vehicle, such as activation of wipers of a windscreen of the vehicle. Additionally or alternatively, an operation characteristic may be a wiper speed of the vehicle. Wiper activation/speed may be indicative of the vehicle travelling on a wet surface, even without a rain sensor of the vehicle being activated by falling rain. The vehicle travelling on such a wet surface may experience noise due to water or other liquid and/or dirt hitting an under-body or other surfaces of the vehicle. In some embodiments one or more coefficients associated with the RTF may be selected based on the wiper activation and/or wiper speed.

One operational characteristic may be a temperature of one or more tyres of the vehicle. In some embodiments one or more coefficients associated with the RTF may be selected based on the tyre temperature.

One operational characteristic may be the position of one or more aperture members of the vehicle and/or the size of one or more apertures of the vehicle. The one or more aperture members may be configured to open and close. Such aperture members may be a cover to a window, a windshield or a retractable roof of the vehicle. In some embodiments one or more coefficients associated with the RTF may be selected based on the position of the one or more aperture members and/or the size of the one or more apertures.

One operational characteristic may be the position of an aerodynamic device of the vehicle. The aerodynamic device may comprise a spoiler, such as a deployable spoiler, for example.

One operational characteristic may be the constituents of one or more components of the vehicle. In some embodiments one or more coefficients associated with the RTF may be selected based on the constituents of the one or more components.

One operational characteristic may be an ambient noise level of the vehicle. In some embodiments one or more coefficients associated with the RTF may be selected based on the ambient noise level.

One operational characteristic may be a load present on a tow bar or hitch point of the vehicle. In some embodiments one or more coefficients associated with the RTF may be selected based on the load present.

One operational characteristic may be a fuel level of the vehicle. In some embodiments one or more coefficients associated with the RTF may be selected based on the fuel level.

In other embodiments, the operational characteristics may be indicative of a position of one or more seats of the vehicle, vehicle occupancy, a seating position of occupants of the vehicle, and/or temperature, such as ambient temperature. The ambient temperature may be an internal ambient temperature i.e. inside the vehicle, such as inside the cabin of the vehicle, or an external ambient temperature of the vehicle i.e. the outside temperature. The vehicle occupancy may be indicative of a number of occupants of the vehicle and, seating position indicative of which of a plurality of positions within the vehicle, such as seats, are occupied. Temperature may influence a time-of-flight of noise experienced within the vehicle.

The received operational data 335 may also be indicative of one or both of a terrain setting of the vehicle and a suspension setting of the vehicle. In some vehicles, particularly vehicles adapted for off-road driving, the vehicle (or a unit thereof) may be arranged to determine the terrain which the vehicle is crossing. Alternatively, the terrain may be manually selected by a driver of the vehicle. The terrain may be determined or selected from amongst a plurality of predetermined types such as sand/desert, mud, grass, tarmac, gravel etc. Alternatively or additionally, in some vehicles the suspension may be configured either automatically or manually by the driver. For example the suspension may be configured in one of a plurality of extension or height states, such as low, medium (normal) or high and/or in one of a plurality of firmness states such as stiff or sport, normal, comfort etc. The data may be indicative of the operational characteristic of one or both the terrain setting and/or suspension setting.

As noted above, the noise configuration unit 110 operatively executes an algorithm for determining the configuration parameters of the noise cancellation unit 120. The algorithm is arranged to select one of the configurations stored in the parameter data store 340 according to the data 325, 335 received via one or both of interfaces 320, 330. That is, according to one or both of the acoustic data and the operational data. For example, in one embodiment the noise configuration unit 110 may select configuration data 305 according to one or more of a number of occupants of the vehicle, a seating position of the occupant(s) within the vehicle and a surface roughness of a surface on which the vehicle is travelling.

The algorithm executed by the processing unit 310 of the noise configuration unit 110 may comprise a pattern matching algorithm for selecting the one or more configuration parameters based on a similarity to previously measured operational characteristics. The pattern matching algorithm may be one of a k-means or nearest neighbour algorithm. As will be appreciated, the k-means algorithm determines one of k clusters corresponding to n observations, where the n observations are the operational characteristics input to the noise configuration unit 110. Each cluster corresponds to a respective configuration of the noise cancellation unit 120.

In another embodiment, the noise configuration unit 110 may comprise one or both of a neural network or support vector machine for selecting configuration parameters for providing optimum noise cancellation performance according to a predetermined cost function. In some embodiments, principal components analysis may be used to reduce the dimensionality of the data indicative of the operational characteristics.

Figure 4:
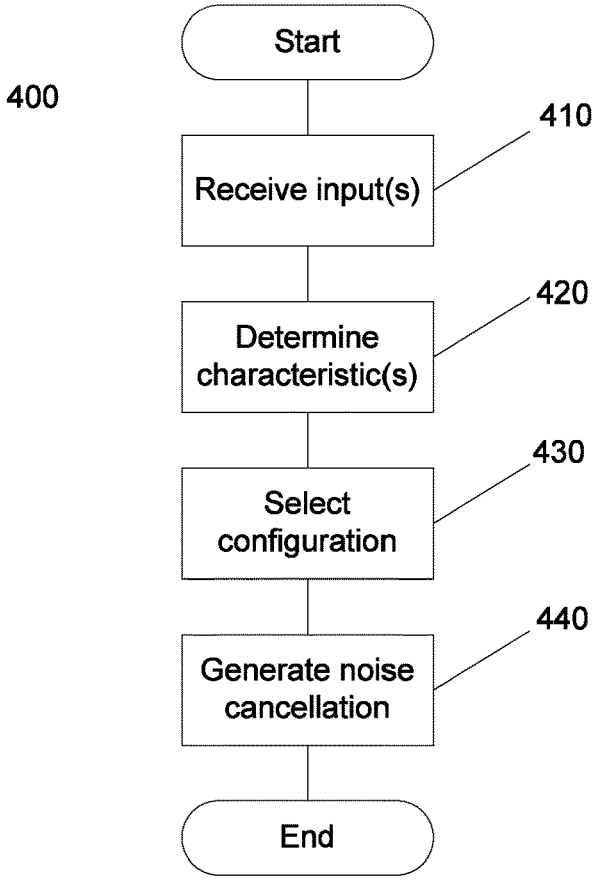
FIG. 4 shows a method according to an embodiment of the invention.

FIG. 4 illustrates a method 400 according to an embodiment of the invention. The method 400 is a method of generating a noise cancellation signal 145. The method 400 may be performed by the noise cancellation system according to an embodiment of the invention as described above.

In step 410 one or more inputs are received. The inputs may comprise acoustic data 325 indicative of audio signals, such as noise, at one or more acoustic sensing devices 131, 132. In some embodiments the inputs may comprise operational data 335 indicative of operational characteristics of the vehicle.

In step 420, based on the one or more received inputs, one or more operational characteristics of the vehicle are determined. In one embodiment the operational characteristics are indicative of the surface on which the vehicle is travelling, such as surface roughness. The operational characteristics may be determined by processing the one or more received inputs by a predetermined algorithm.

In step 430, based on the determination made in step 420 a configuration of the noise cancellation unit 120 is selected. The configuration may be selected from amongst a plurality of predetermined configurations. Each configuration may be represented by one of more configuration parameters which are provided from the noise configuration unit 110 to the noise cancellation unit 120. The one or more configuration parameters may be coefficients associated with one or more transfer functions. The configuration parameters may configure one or more filters according to the determined operational characteristics.

In step 440 a noise cancellation signal 145 is generated based on the configuration selected in step 430. The noise cancellation signal 145 is generated based on the output of the acoustic sensing devices 131, 132. In some embodiments, the noise cancellation signal may be further generated, in a closed-loop system, based on the feedback signal 215 to the noise cancellation system 100 indicative of noise within the noise cancellation zone 200.

Figure 5:
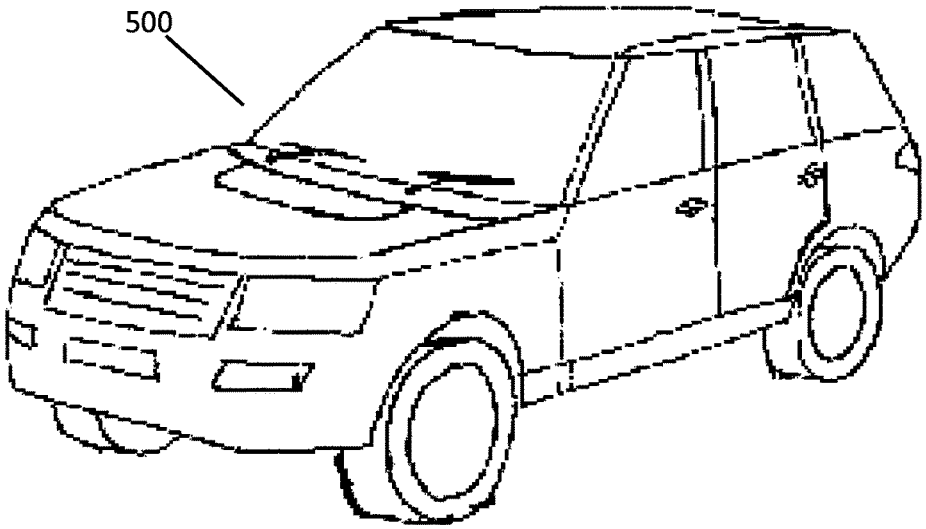
FIG. 5 shows a vehicle comprising a system according to an embodiment of the invention.

FIG. 5 illustrates a vehicle 500 according to an embodiment of the invention. The vehicle comprises a noise cancellation system such as described above in relation to the preceding figures.

Advantageously embodiments of the invention adapt a configuration of the noise cancellation system to operational characteristics, such that a noise cancellation signal is responsive to changes in operating environment. In this way noise cancellation may be improved.

It will be appreciated that embodiments of the present invention can be realised in the form of hardware, software or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are embodiments of machine-readable storage that are suitable for storing a program or programs that, when executed, implement embodiments of the present invention. Accordingly, embodiments provide a program comprising code for implementing a system or method as claimed in any preceding claim and a machine readable storage storing such a program. Still further, embodiments of the present invention may be conveyed electronically via any medium such as a communication signal carried over a wired or wireless connection and embodiments suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed. The claims should not be construed to cover merely the foregoing embodiments, but also any embodiments which fall within the scope of the claims.

The invention claimed is:

1. A noise cancellation system, comprising:

a noise configuration unit comprising one or more electronic processors having one or more electrical inputs to receive data indicative of one or more operating conditions of a vehicle, the noise configuration unit to select one or more noise cancellation configuration parameters based thereon; and a noise cancellation unit separate and distinct from the noise configuration unit, the noise cancellation unit comprising one or more electronic processors, the noise cancellation unit to receive one or more noise signals that are separate and distinct from the data indicative of one or more operating conditions of the vehicle, to receive from the noise configuration unit one or more configuration parameters selected by the noise configuration unit, to determine an in-vehicle noise cancellation signal based on the one or more noise signals according to the one or more configuration parameters selected by the noise configuration unit and to output the in-vehicle noise cancellation signal for reducing noise in the vehicle, wherein the noise configuration unit is configured to:

determine an attribute of a surface on which the vehicle is travelling while in use based on a spectral composition of at least one of the one or more noise signals; and select the one or more noise cancellation configuration parameters based on both the attribute and the data indicative of one or more operating conditions of the vehicle.

2. The noise cancellation system of claim 1, wherein the attribute of the surface is a roughness of the surface and the noise configuration unit is further configured to:

determine the roughness of the surface based on at least one of the noise signals received from a noise sensor associated with the vehicle; and select the one or more noise cancellation configuration parameters based on the roughness of the surface.

3. The noise cancellation system of claim 2, wherein the noise sensor is associated with a suspension of the vehicle.

4. The noise cancellation system of claim 1, wherein the noise configuration unit is further configured to determine the attribute of the surface based on both of an amplitude and the spectral composition of the at least one of the one or more noise signals.

5. The noise cancellation system of claim 1, wherein the one or more operating conditions comprises any one or more of:

a speed of the vehicle;

a speed of one or both of an engine and a traction motor associated with the vehicle;

an activation of one or more wipers associated with the vehicle; and one or more of ambient temperature and a configuration of a vehicle suspension, the ambient temperature being one of or both an internal ambient temperature and an external ambient temperature of the vehicle.

6. The noise cancellation system of claim 1, wherein the noise configuration unit is further configured to operatively perform a pattern matching algorithm to select the one or more noise cancellation configuration parameters based on a similarity of an operating condition to one or more predetermined operating conditions, optionally the pattern matching algorithm being one of a k-means or nearest neighbor algorithm.

7. The noise cancellation system of claim 1, wherein the one or more noise cancellation configuration parameters are associated with at least one function for determining the in-vehicle noise cancellation signal based on the one or more noise signals.

8. The noise cancellation system of claim 7, wherein the noise cancellation configuration parameters associated with the at least one function are one or more filter coefficients.

9. The noise cancellation system of claim 7, wherein the at least one function includes a speaker transfer function (STF) indicative of a transfer function from one or more audio output devices.

10. The noise cancellation system of claim 7, wherein the at least one function includes a reference transfer function (RTF) indicative of a transfer function from one or more noise sensors.

11. A vehicle comprising a noise cancellation system as claimed in claim 1.

12. A method of generating a noise cancellation signal, comprising:

receiving data indicative of one or more operating conditions of a vehicle;

receiving one or more noise signals;

determining an attribute of a surface on which the vehicle is travelling based on a spectral composition of at least one of the one or more noise signals;

selecting one or more noise cancellation configuration parameters based on both the received data indicative of one or more operating conditions of the vehicle and the attribute;

generating an in-vehicle noise cancellation signal based on the one or more noise signals according to the one or more selected configuration parameters; and outputting the in-vehicle noise cancellation signal for reducing noise in the vehicle.

13. The method of claim 12, wherein the attribute of the surface is a roughness of the surface and the method further comprises:

determining the roughness of the surface based on at least one of the noise signals received from a noise sensor associated with the vehicle; and selecting the one or more noise cancellation configuration parameters based on the roughness of the surface.

14. The method of claim 13, wherein the noise sensor is associated with a suspension of the vehicle.

15. The method of claim 12, further comprising determining the attribute of the surface based on both of an amplitude and the spectral composition of the at least one of the one or more noise signals.

16. The method of claim 12, wherein the one or more operating conditions comprises any one or more of:

a speed of the vehicle;

a speed of one or both of an engine and a traction motor associated with the vehicle;

an activation of one or more wipers associated with the vehicle; and one or more of ambient temperature and a configuration of a vehicle suspension, the ambient temperature being one of or both an internal ambient temperature and an external ambient temperature of the vehicle.

17. The method of claim 12, further comprising operatively performing a pattern matching algorithm for selecting the one or more noise cancellation configuration parameters based on a similarity of an operating condition to one or more predetermined operating conditions.

18. The method of claim 12, wherein the one or more noise cancellation configuration parameters are associated with at least one function for determining the noise cancellation signal based on the one or more noise signals, optionally wherein the one or more noise cancellation configuration parameters associated with the at least one function are one or more filter coefficients.

19. The method of claim 18, wherein the function is one of a speaker transfer function (STF) indicative of a transfer function from one or more audio output devices and a reference transfer function (RTF) indicative of a transfer function from one or more noise sensors.

20. A non-transitory computer readable medium comprising computer readable instructions which, when executed by a computer, causes performance of a method according to claim 12.

* * * * *